US006148795A

United States Patent [19]

Gerhardt et al.

[11] Patent Number: 6,148,795

[45] Date of Patent: Nov. 21, 2000

[54] METHOD AND ARRANGEMENT FOR OPERATING AN INTERNAL COMBUSTION ENGINE

[75] Inventors: Jürgen Gerhardt, Oberriexingen; Werner Hess, Stuttgart, both of Germany

[73] Assignee: Robert Bosch GmbH, Stuttgart, Germany

[21] Appl. No.: 09/267,393

[22] Filed: Mar. 15, 1999

[30] Foreign Application Priority Data

Mar. 21, 1998 [DE] Germany ..... 198 12 485

[51] Int. Cl.[7] ..... F02D 41/02

[52] U.S. Cl. ..... 123/436; 123/350; 123/399; 180/197; 477/113

[58] Field of Search ..... 123/436, 333, 123/399, 350; 180/197; 477/110, 113; 701/101, 102, 104

[56] References Cited

U.S. PATENT DOCUMENTS

| | | | |
|---|---|---|---|
| 5,245,966 | 9/1993 | Zhang et al. | 123/339.19 |
| 5,421,302 | 6/1995 | Livshits et al. | 123/339.23 |
| 5,484,351 | 1/1996 | Zhang et al. | 477/113 |
| 5,558,178 | 9/1996 | Hess et al. | 180/197 |
| 5,623,906 | 4/1997 | Storhok | 123/419 |
| 5,657,230 | 8/1997 | Hess et al. | 701/104 |
| 5,676,111 | 10/1997 | Zhang | 123/325 |
| 5,676,112 | 10/1997 | Bauer et al. | 123/333 |
| 5,692,471 | 12/1997 | Zhang et al. | 123/350 |
| 5,692,472 | 12/1997 | Bederna et al. | 123/350 |
| 5,765,527 | 6/1998 | Lehner et al. | 123/339.1 |
| 5,832,897 | 11/1998 | Zhang | 123/352 |
| 6,000,376 | 12/1999 | Hess et al. | 123/333 |

FOREIGN PATENT DOCUMENTS 196 18 385 11/1997 Germany .

OTHER PUBLICATIONS

"Ausrüstung von Mess– und Versuchsfahrzeugen: Vom Sensor bis zur Auswertung" by M. Koslowski et al, ATZ/MTZ Sonderausgabe System Partners 97, pp. 28 to 31.

*Primary Examiner*—Henry C. Yuen
*Assistant Examiner*—Hieu T. Vo
*Attorney, Agent, or Firm*—Walter Ottesen

[57] ABSTRACT

A method for operating an internal combustion engine includes evaluating a variable which represents the load of the engine. This variable is determined from a torque value measured at an output shaft of the engine. The invention is also directed to an arrangement for operating the engine.

12 Claims, 2 Drawing Sheets

METHOD AND ARRANGEMENT FOR OPERATING AN INTERNAL COMBUSTION ENGINE

BACKGROUND OF THE INVENTION

A method and arrangement for operating an internal combustion engine is disclosed in German patent publication 196 18 385. In this publication, a control system for an internal combustion engine is described wherein the fresh air charge, which is supplied to the engine, is determined on the basis of the rpm and a measured variable. The measured variable represents the load on the engine and the fresh air charge is the air mass which is inducted by the engine per cylinder. For the control of the engine, the fresh air charge is, for example, evaluated for: the determination of a desired value for the air supply to the engine, for the computation of the ignition angle and/or for the computation of the fuel mass to be injected.

Variables such as the inducted air mass, the intake manifold pressure, the throttle flap position, et cetera, are provided as variables representing the load. For present-day control systems, at least two measuring devices are utilized, for example, a sensor for detecting the throttle flap position and a sensor for detecting the inflowing air mass or even a sensor for detecting the intake manifold pressure. Especially for engines operated with the throttle flap fully open, several of these signals (for example, throttle flap position, intake manifold pressure) are not a reliable measure for the load.

The use of sensors which measure the effective torque directly at the crankshaft of the engine is known. Such a sensor is described, for example, in the publication entitled: ATZ/MTZ Sonderausgabe System Partners 97, pages 28 to 31.

A torque model is known from U.S. Pat. No. 5,692,471 which describes the dependency of the torque of an engine on the adjusted load state, the ignition angle position, the actual adjustment of the air/fuel ratio as well as the number of inhibited or suppressed cylinders.

U.S. Pat. No. 5,484,351 discloses measures with the aid of which the lost torque of an engine is determined; that is, the combustion torque which must be developed for compensating the internal losses, the heat losses and the torque requirements of additional consumers.

SUMMARY OF THE INVENTION

It is an object of the invention to provide sensors in the detection of the charge or load which have a signal which is reliable even under these operating conditions and can be converted into the charge or load.

The method of the invention is for operating an internal combustion engine connected to a transmission. The method includes the steps of: measuring a torque at an output shaft of the engine and/or at an output shaft of the transmission; determining a variable representing engine load from the measured torque; and, controlling the torque of the engine in accordance with at least one desired value and evaluating the variable while controlling the torque.

By computing the charge from the torque signal, which is determined by the torque sensor, one load sensor, that is, one of the following can be omitted: either the throttle flap position sensor, the hot film air mass sensor for detecting the inflowing air mass or the intake manifold pressure sensor. In this way, considerable cost reductions are achieved.

It is especially advantageous when the load signal, which is determined from the torque signal, replaces the ancillary load signal which defines the redundancy to the main load signal and is evaluated for emergency or fault monitoring purposes. This signal does not require the precision needed for the main load signal. Here, and for a system which operates on the basis of the throttle flap position as the main load signal, the redundant signal of the intake manifold pressure or of the air-mass sensor and the corresponding sensor can be omitted.

It is especially advantageous that the charge of the engine can be calculated from the torque signal by utilizing a constant torque model. In this way, even in an engine which is operated throttle-free, the generation of an additional load signal, is made possible in the throttle-free operation. Engines which are operated throttle-free include, for example, a diesel engine, a gasoline direct injector, an ignition engine having a variable valve stroke or an electromagnetic valve adjustment. In these engines, the load signal principles known to date are not applicable which are based on the detection of the throttle flap position or the intake manifold pressure.

The use of a consistent torque model is advantageous, the inverse use of which permits the computation of the cylinder charge or the engine load to be made on the basis of the measured torque.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
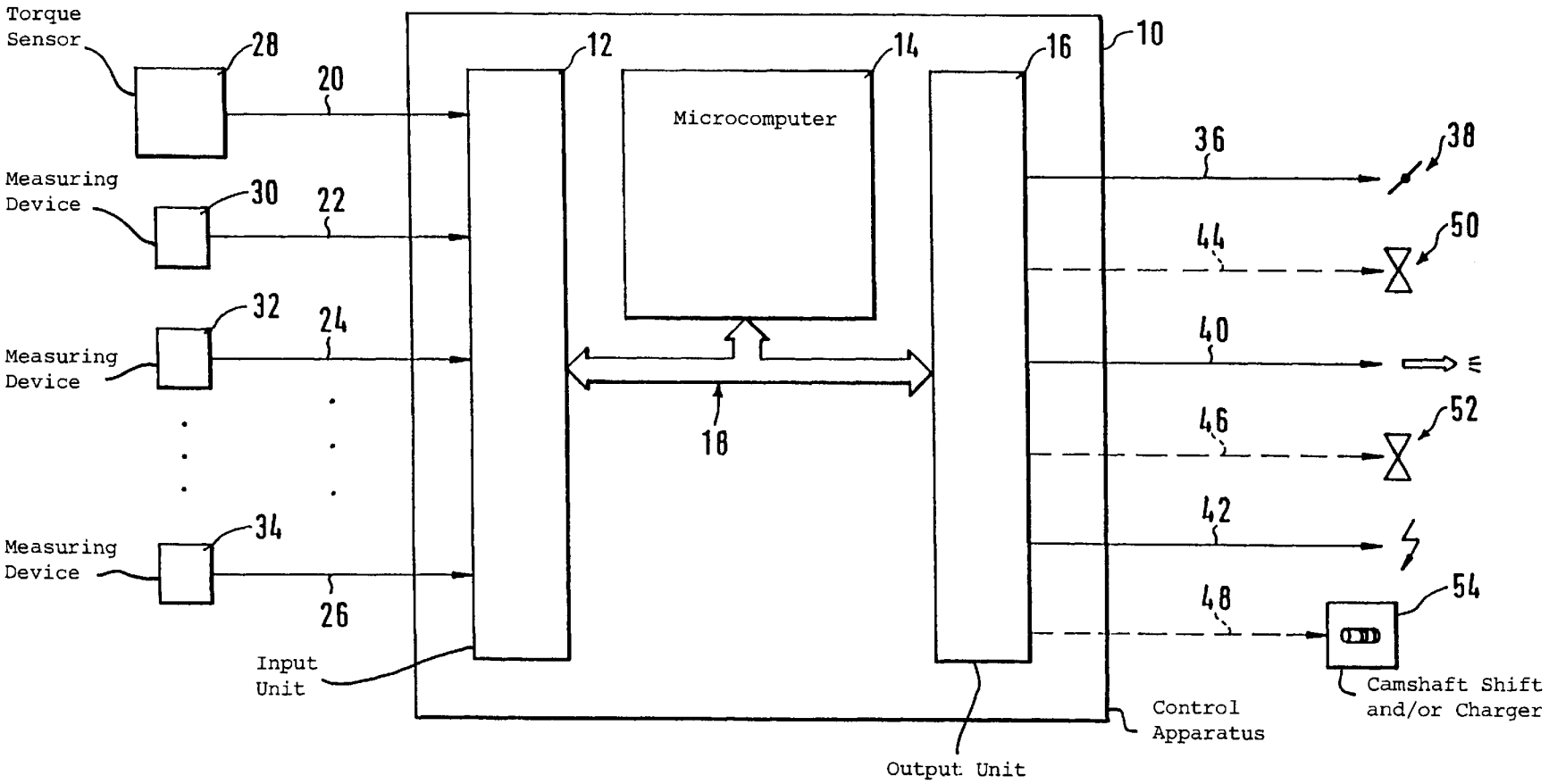
FIG. 1 is a block diagram of a control arrangement for controlling an internal combustion engine; and, FIG. 2 is a sequence diagram for determining a signal, which represents the engine load, from the measured torque signal.

FIG. 1 shows a control arrangement for controlling the torque or the power of an internal combustion engine.

The control apparatus 10 includes an input circuit 12, at least one microcomputer 14 and an output circuit 16. The input circuit, microcomputer and output circuit are connected to each other via a bus system 18 for the mutual exchange of data. Input lines 20, 22 and 24 to 26 are connected to the input circuit 12 of the control unit 10.

In a preferred embodiment, these input lines are included in a bus system such as CAN. Here, the input line 20 connects the control apparatus 10 to a torque sensor 28 which detects the torque at an output shaft of the engine, for example, at the crankshaft. The torque sensor 28 can alternatively or in addition detect the torque at an output shaft of a transmission. This torque sensor 28 is, for example, known from the state of the art cited initially herein. The input line 22 connects the control apparatus 10 to a measuring device 30 for detecting the degree of actuation of an operator-controlled element actuated by the driver (an accelerator pedal). Furthermore, measuring devices 32 to 34 are provided which detect additional operating variables of the engine and/or of the vehicle and transmit corresponding measurement signals via the lines 24 to 26 to the control apparatus 10. Examples of such measured variables are engine rpm, exhaust-gas composition (lambda), a throttle flap position, et cetera. The control apparatus 10 controls the power variables of the engine via the output unit 16. An electrically actuable throttle flap 38 is controlled via a first output line 36 to influence the air inflow to the engine.

Further, the fuel supply and the ignition angle are adjusted via output lines 40 and 42, respectively. In addition, and depending upon the configuration of the engine, output lines 40, 46 and/or 48 are provided via which the control apparatus 10 drives a tank-venting valve 50, an exhaust-gas return valve 52, the drive 54 of a camshaft shift and/or a charger.

Depending upon the type of the engine (diesel, intake manifold injection, direct gasoline injection) and the control model used, the power or the torque of the engine is controlled in dependence upon the driver command while considering the operating variables of the engine and/or of the vehicle. In any event, a signal, which represents the engine load, is necessary for controlling the engine. In the preferred embodiment, this is the cylinder charge. In other embodiments, it is the intake manifold pressure, the air-mass flow, et cetera. As described below, these variables are derived from the measured torque. The variable, which represents the load, is applied in the control of the engine for: the adjustment of the ignition angle, the metering of fuel, the air supply, et cetera.

In the preferred embodiment, the control concept of the control of the internal combustion engine relates to a torque-orientated control. As mentioned initially herein with respect to the state of the art, a desired torque value, which is pregiven by the driver, is formed from the degree of actuation of the operator-controlled element of the driver while considering at least the engine rpm. This desired torque value is, if required, compared to the torque values formed by other open-loop or closed-loop control systems and a desired torque value is selected which serves to adjust the torque of the engine. With reference to the adjustment of the air inflow, and as described in the state of the art, the desired torque value is converted into a desired value for the cylinder charge, which, in turn, is converted into a desired value for the position of the throttle flap. To control the actual torque to the desired torque, there is an intervention in the air inflow in the manner known per se from the state of the art as well as an intervention in the adjustment in the ignition angle and the metering of fuel, et cetera.

In the preferred embodiment, two load variables are formed for purposes of redundancy. The one load variable is determined in dependence upon the throttle flap position and the engine rpm and the other load variable is derived in accordance with a torque model from the measured torque signal.

In addition to use in intake manifold injectors, the procedure for determining the load variable from the measured torque signal can be used also for other internal combustion engines such as diesel engines, gasoline-direct injection engines, spark-ignition engines with variable valve stroke, or spark-ignition engines with electromagnetic valve adjustment. The load variable is determined from the measured torque and can serve as a main load variable or as an ancillary load signal in throttle-free operation where the load signal formation on the basis of the throttle flap position or the intake manifold pressure does not function.

The torque model can be described in a simplified manner by the following equation:

$$mi=mi_opt*eta_zw*eta_lam*eta_ausbl \quad (1)$$

wherein:

mi is the internal torque of the engine, that is, the torque generated by the combustion in the high pressure phase;

mi_opt is the optimal torque for lambda=1, optimal ignition angle position (maximum torque) and when all cylinders are fired;

eta_zw is the efficiency of the ignition angle, that is, the deviation of the actual ignition angle from the optimal ignition angle with this deviation being referred to the torque;

eta_lam is the corresponding efficiency of the mixture composition; and, eta_ausbl is the efficiency of the cylinder suppression.

As shown above in the discussion of the state of the art, the number of cylinders to be suppressed and the adjusted ignition angle as well as the deviation thereof from the optimal value are known. Likewise, when an operation of the engine is outside of the stoichiometric range, the deviation of the actual mixture composition from the stoichiometric value is known, for example, by the use of a broadband lambda probe.

For the measured effective torque mf, and with knowledge of the lost torque mloss, the internal torque can likewise be computed:

$$mi=mf+mloss \quad (2)$$

From the above, it follows that:

$$mf+mloss=mi_opt(rl_act,nmot)*eta_zw*eta_lam*eta_ausbl \quad (3)$$

wherein: rl_act is the actual cylinder charge and nmot is the engine rpm.

In steady-state operation, the actual cylinder charge rl_act can be determined from equation (3).

For an intake manifold injector, it must be noted that the ignition angle efficiency is also dependent upon the actual charge. This deviation is, however, slight in wide characteristic field ranges (for example, at high loads) and is controllable in other regions via a slow-running compensation.

Figure 2:
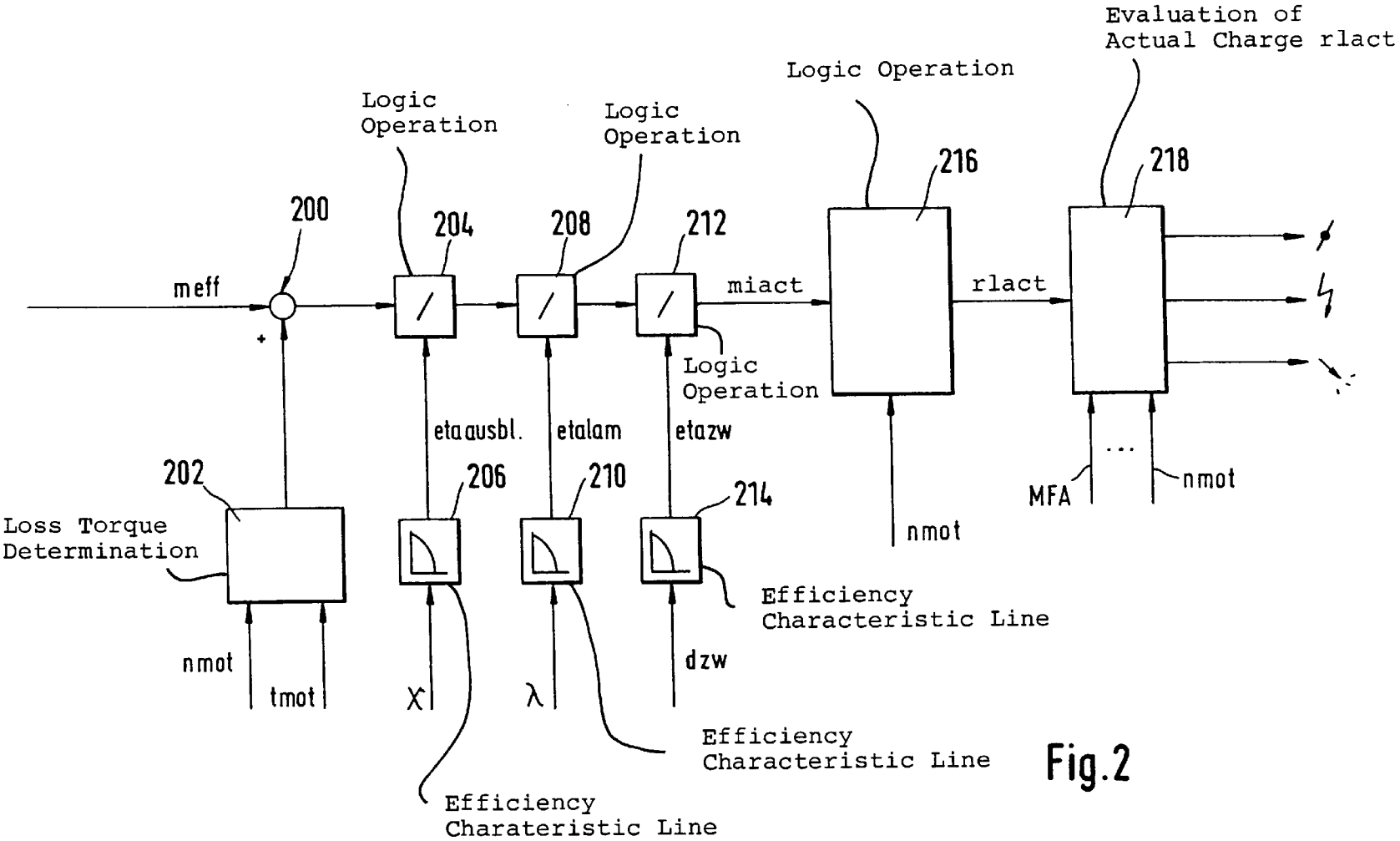

In FIG. 2, a sequence diagram is shown which shows the described procedure for computing the charge rl_act from the measured effective torque mf.

The measured effective torque mf at an output of the engine is logically coupled to the lost torque mloss in a logic element 200. In the preferred embodiment, this operation is an addition. The lost torque mloss includes all torque components together which generate no torque at the output shaft of the engine, for example, torque components which must be generated to overcome the internal losses, which are to be generated for driving ancillary apparatus such as power steering, climate control, et cetera, and heat losses. The lost torque is, for example, determined in the manner known per se from the state of the art in block 202 from operating variables such as engine rpm nmot, engine temperature tmot, the status of ancillary equipment, the exhaust-gas counterpressure, et cetera. The sum of measured torque and lost torque is then corrected by the deviations of the actual adjustments of the engine from the optimal values. For this purpose, a logic-coupling operation 204 (especially a division) is carried out in that the sum is divided by the efficiency of the cylinder suppression eta_ausbl. This efficiency is determined from the efficiency characteristic line 206 in dependence upon the number X of the suppressed cylinders. The torque, which is corrected in this way, is logically coupled in a further logic-coupling operation 208 (also especially via a division) with the efficiency of the lambda adjustment eta_lam. This efficiency defines the deviation of the actual lambda adjustment from the optimal value lambda 1 and is determined in the efficiency characteristic line 201 in dependence upon the actual lambda value. The corrected torque is then subjected to a logic-coupling operation 212 wherein the torque is divided by the efficiency eta_zw of the ignition angle adjustment. This efficiency is formed in the efficiency characteristic line 214 in dependence upon the deviation dzw of the actual ignition angle setting from the optimal value zw_opt at which the torque of the engine is a maximum.

The result of the logic-coupling operations 204, 208 and 212 is the internal actual torque mi_act which is coupled at least with engine rpm nmot in block 216. The result of this logic coupling is the actual cylinder charge rl_act of the engine. This operation is known from the state of the art as is the evaluation of the actual charge rl_act which takes place in block 218 in connection with other variables such as driver command torque mfa, engine rpm nmot, et cetera to the control values for the air inflow, fuel metering, the ignition angle setting, et cetera.

In addition to the computation of the actual charge rl_act from the internal actual torque rl_act which is determined from the measured effective torque in accordance with a torque model (or as an alternative thereto), in other embodiments, other variables, which represent the load are determined, for example, an air-mass flow or an intake manifold pressure value.

In addition to the use of the described torque model, which is based on optimal values, other torque models are used in other embodiments, for example, models which have another reference point which is not optimal. What is essential is that the torque model is consistent, that is, that the actual value of the torque can be determined from the adjusted variables as well as the desired value for the adjusting variables from the desired value of the torque in accordance with the same model equations.

In systems, which have no definite relationship between the charge and the load, a variable should be additionally considered which characterizes the concentration of oxygen in the exhaust gas. Accordingly, for systems with a stratified charge and/or for diesel engines, an output signal of a lambda probe is to be evaluated in addition.

It is understood that the foregoing description is that of the preferred embodiments of the invention and that various changes and modifications may be made thereto without departing from the spirit and scope of the invention as defined in the appended claims.

What is claimed is:

1. An arrangement for operating an internal combustion engine having a transmission, the arrangement comprising:

means for detecting an input value (MFA);

a control apparatus for controlling the torque of said engine in dependence upon said input value (MFA);

a sensor for measuring a torque (meff) at an output shaft of at least one of said engine and said transmission and for supplying a signal indicating said torque (meff);

said control apparatus including means for receiving said signal;

said control apparatus further including a torque model operating in dependence upon the measured torque (meff) to determine a variable (rlact) representing the engine load; and, said control apparatus including means for evaluating said variable (rlact) and said input value (MFA) when controlling said torque.

2. A method for operating an internal combustion engine connected to a transmission, the method comprising the steps of:

measuring a torque (meff) at an output shaft of at least one of said engine and said transmission;

converting said torque (meff) into a variable (rlact), which represents engine load, utilizing a torque model;

detecting an input value (MFA) for the torque of said engine; and, determining at least one control quantity of said engine on the basis of said variable (rlact) while considering said input value (MFA).

3. A method for operating an internal combustion engine connected to a transmission, the method comprising the steps of:

measuring a torque (meff) at an output shaft of at least one of said engine and said transmission;

determining a variable (rlact), which represents engine load, in dependence upon the measured torque (meff) by utilizing a torque model;

detecting an input value (MFA); and, controlling the torque of said engine in dependence upon said input value (MFA) and said variable (rlact) representing the engine load.

4. The method of claim 3, wherein said variable is one of: the cylinder charge, an air mass flow and an intake manifold pressure value.

5. The method of claim 3, comprising the further step of determining said variable from the measured torque in accordance with a torque model.

6. The method of claim 5, wherein the measured torque (mf) is connected to the torque losses (mloss) which are to be overcome by said engine.

7. The method of claim 5, wherein deviations from optimal values are considered.

8. The method of claim 7, wherein said deviations are deviations of at least one of the following: the number of fired cylinders, the setting of the air/fuel mixture and the ignition angle from pregiven values.

9. The method of claim 3, wherein said engine is one of the following: an intake manifold injection engine, a gasoline direct injection engine or a diesel engine.

10. The method of claim 3, comprising the further step of determining said variable during wide-open throttle operation of said engine.

11. The method of claim 3, wherein said variable is an ancillary load signal which is used to check at least one of a main load signal and as a substitute of said main load signal.

12. The method of claim 11, wherein said main load signal is derived from a throttle-flap position.

* * * * *